US006955594B2

(12) United States Patent
Kennedy et al.

(10) Patent No.: US 6,955,594 B2
(45) Date of Patent: Oct. 18, 2005

(54) MINE DOOR SYSTEM INCLUDING AN AIR PRESSURE RELIEF DOOR

(76) Inventors: William R. Kennedy, P.O. Box 138, Taylorville, IL (US) 62568; John M. Kennedy, P.O. Box 138, Taylorville, IL (US) 62568

( * ) Notice: Subject to any disclaimer, the term of this patent is extended or adjusted under 35 U.S.C. 154(b) by 0 days.

(21) Appl. No.: 10/608,901

(22) Filed: Jun. 27, 2003

(65) Prior Publication Data

US 2004/0266329 A1 Dec. 30, 2004

(51) Int. Cl.[7] ..... E06B 5/16
(52) U.S. Cl. ..... 454/169; 49/67; 405/144
(58) Field of Search ..... 454/168, 169, 454/195; 49/62, 7; 405/144

(56) References Cited

U.S. PATENT DOCUMENTS

| | | | |
|---|---|---|---|
| 1,716,707 A | 6/1929 | Schoelkopf | |
| 2,550,349 A | 4/1951 | Helz | |
| 2,748,855 A | 6/1956 | Siems et al. | |
| 2,918,890 A | 12/1959 | Gail | |
| 3,883,014 A | 5/1975 | Glomski et al. | |
| 3,921,335 A | 11/1975 | Hewitt et al. | |
| 3,936,977 A | 2/1976 | Runft et al. | |
| 4,510,714 A | 4/1985 | Kasper et al. | |
| 4,765,346 A | 8/1988 | Simin | |
| 4,911,577 A | 3/1990 | Kennedy et al. | |
| 4,915,540 A | 4/1990 | Kennedy et al. | |
| RE34,053 E | 9/1992 | Kennedy et al. | |
| 5,168,667 A | 12/1992 | Kennedy et al. | |
| RE34,220 E | 4/1993 | Kennedy et al. | |
| 5,222,838 A | 6/1993 | Kennedy et al. | |
| 5,240,349 A | 8/1993 | Kennedy et al. | |
| 5,412,916 A | 5/1995 | Kennedy et al. | |
| 5,466,187 A | 11/1995 | Kennedy et al. | |
| 5,515,649 A | 5/1996 | Strab | |
| 5,795,367 A | 8/1998 | Kennedy et al. | |
| 5,812,741 A | 9/1998 | Kennedy et al. | |
| 6,032,986 A | 3/2000 | Kennedy et al. | |
| RE36,853 E | 9/2000 | Kennedy et al. | |
| 6,164,871 A | 12/2000 | Kennedy et al. | |
| 6,220,785 B1 | 4/2001 | Kennedy et al. | |
| 6,256,946 B1 | 7/2001 | Kennedy et al. | |
| 6,264,549 B1 | 7/2001 | Kennedy et al. | |
| 6,379,084 B1 | 4/2002 | Kennedy et al. | |
| 6,394,707 B1 | 5/2002 | Kennedy et al. | |
| 6,419,324 B1 | 7/2002 | Kennedy et al. | |
| 6,425,820 B1 * | 7/2002 | Kennedy et al. | 454/169 |
| 6,457,906 B1 | 10/2002 | Kennedy et al. | |
| 6,594,954 B1 | 7/2003 | Kennedy et al. | |
| 2003/0079423 A1 | 5/2003 | Kennedy et al. | |

FOREIGN PATENT DOCUMENTS

| | | | |
|---|---|---|---|
| FR | 2301685 A * | 10/1976 | E06B/5/00 |
| GB | 1485981 A * | 9/1977 | E05F/15/04 |
| JP | 2001235576 A * | 8/2001 | G21C/13/02 |

OTHER PUBLICATIONS

Jack Kennedy Metal Products & Buildings, Inc., Kennedy Power Machine Doors brochure, Jul. 2, 2002 (Copy of Declaration of William R. Kennedy and Form Transmittal Letter verifying publication date).

The American Mine Door Company, Canton Doors . . . for Trucks . . . for Motors . . . Speed up haulage brochure, admitted prior art.

* cited by examiner

*Primary Examiner*—Harold Joyce
(74) *Attorney, Agent, or Firm*—Senniger Powers

(57) ABSTRACT

A mine door of the present invention is adapted for installation in a mine passageway and includes a leaf adapted for swinging between a closed position and an open position. The leaf may be mounted in a frame, and a stopping wall may surround the frame. When closed, the leaf is subject to a differential in air pressure involving higher pressure on one of the faces of the leaf than on the other of the faces of the leaf. The leaf, the frame, or the stopping has an opening therein for passage of air therethrough from adjacent the one of the faces of the leaf to adjacent the other of the faces to more nearly equalize the pressure on the faces and thereby facilitate opening the leaf.

35 Claims, 11 Drawing Sheets

MINE DOOR SYSTEM INCLUDING AN AIR PRESSURE RELIEF DOOR

BACKGROUND OF THE INVENTION

The present invention relates generally to mine stoppings and mine doors, and more particularly to relief doors for relieving air pressure against mine doors.

"Stoppings" are widely used in mines to stop off the flow of air in passageways in the mines, a stopping generally being a metal or masonry (e.g., concrete block) wall installed at the entrance of a passageway to block flow of air therethrough. Such stoppings are typically provided with a doorway or opening and a door therein for occasional access to the blocked-off passageway. Co-assigned U.S. Pat. No. 5,240,349, which is incorporated herein by reference, shows power-operated mine door systems mounted in such stoppings. The door system comprises a door frame 22 defining a doorway and two door leafs 24, 28 hinged on the door frame. The door leafs are opened by power means comprising hydraulic cylinders 94, 96 mounted on supports attached to the door frame.

Doors used in mines operate under conditions not usually encountered by typical doors. Mine doors are subject to large forces due at least in part to air flow in the mine and consequent air pressure differentials on opposite sides of the door. Each mine door leaf can be as large as 10 feet wide and 20 feet high, and weigh more than a thousand pounds when designed for a peak air pressure differential of 7 inches water gauge (IWG) and over two thousand pounds when designed for a peak pressure differential of 20 IWG. Therefore, the mine door leafs can be subject to large forces from the large air pressure differential on opposite sides of the leafs. The large forces require the use of expensive, powerful door operating mechanisms.

SUMMARY OF THE INVENTION

Among the several objects of the present invention may be noted the provision of a mine door adapted to be installed in a mine stopping; the provision of such a mine door adapted for powered operation and which is operable even when the door is subjected to a large pressure differential; the provision of such a mine door which may be powered pneumatically or hydraulically; and the provision of such a mine door and stopping adapted to include a relief opening for relieving air pressure against the door to thereby facilitate powered operation of the door.

Briefly, a mine door of the present invention is adapted for installation in a mine passageway and comprises a leaf adapted to be mounted in the passageway for swinging between a closed position and an open position. The leaf has a first face facing in a direction in which it swings open and a second face facing an opposite direction in which it swings closed. The leaf is adapted for installation in the passageway where the leaf when closed is subject to a differential in air pressure involving higher pressure on one of said faces of the leaf than on the other of said faces of the leaf. The leaf has an opening therein for passage of air therethrough from adjacent said one of said faces of the leaf to adjacent the other of said faces to more nearly equalize the pressure on said faces and thereby reduce the force required to open or close the leaf. A power-operated closure for said opening is movable between a closed position blocking passage of air and an open position allowing passage of air.

In another aspect, a mine stopping system of the invention is installed in the mine passageway and comprises a wall extending at least partway across the passageway and a door frame installed in or adjacent the wall to define a doorway to allow passage of machinery. A door leaf is hinged on the door frame for swinging between a closed position in the doorway and an open position. The leaf when closed being subject to a differential in air pressure involving higher pressure on one of said faces of the leaf than on the other of said faces. An opening is disposed in at least one of said leaf, wall and door frame for passage of air therethrough to more nearly equalize the pressure on said faces of the leaf and thereby reduce the force required to open or close the leaf. A power-operated closure for said at least one opening is movable between a closed position blocking passage of air and an open position allowing passage of air.

In yet another aspect, a mine door unit of the present invention comprises a door frame adapted to be installed in the passageway to define a doorway sized and shaped to allow passage of machinery and a leaf hinged on the door frame for moving between a closed position for at least partially closing the doorway and an open position to permit passage of machinery through the doorway. A man doorway in the leaf is sized and shaped to allow passage of personnel and a man door is mounted on the leaf for closing the man doorway. A pressure relief opening is in the leaf and is not in the man door. A closure is mounted on the leaf for moving between a closed position for closing the pressure relief opening and an open position for relieving pressure against the leaf to facilitate opening of the leaf, the closure also not being on the man door.

In still another aspect, a mine stopping system comprises a plurality of stoppings mounted in the passageway in spaced apart relation. The stoppings form an airlock with an airlock space therebetween and each stopping includes a door leaf mounted for moving between open and closed positions. At least one of said stoppings includes a pressure relief opening therein and a power-operated closure mounted adjacent the opening for moving between a closed position for closing the pressure relief opening and an open position for relieving air pressure against the leaf to facilitate opening or closing of the leaf.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
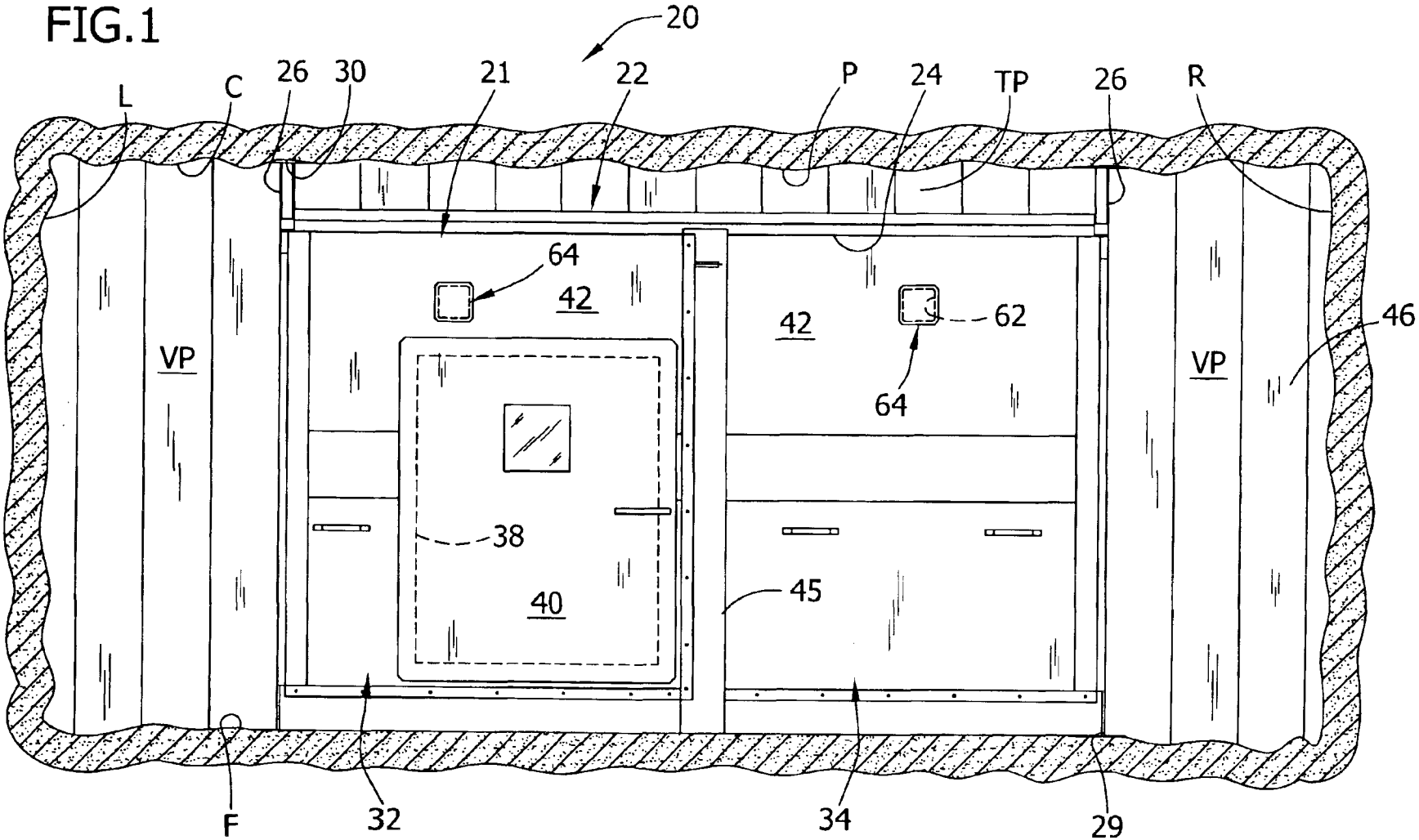
FIG. 1 is a front elevation of one embodiment of a mine stopping and two-leaf door unit of the present invention as installed in a mine passageway.

Referring to FIG. 1, there is generally indicated at 20 one embodiment of a mine stopping of this invention installed in a mine passageway P having a floor F, ceiling C and left and right ribs indicated at L, R, respectively. A door unit of the stopping is generally designated 21 and comprises a door frame, generally designated 22, which defines a doorway 24 to allow passage of machinery. The door frame 22 comprises a pair of vertical metal columns 26 at opposite sides of the doorway and a lintel 28 supported by the columns and extending across the top of the doorway. As described more completely in U.S. Pat. No. 5,240,349, incorporated herein by reference, each column 26 has a foot (lower) end 29 engageable with the floor F of the passageway, a head (upper) end 30 engageable with the ceiling C, and is made up of a plurality of sections (e.g., tubular sections) which may be locked in telescoped relation to one another. The lintel 28 is connected at its opposite ends to the columns 26. A jack (not shown) may be used to install the columns, such as described in U.S. Pat. Nos. Re. 5,240,349 and 5,222,838, which are incorporated herein by reference. Other types of door frames or other structures for supporting the door may be used within the scope of this invention.

Figure 5:
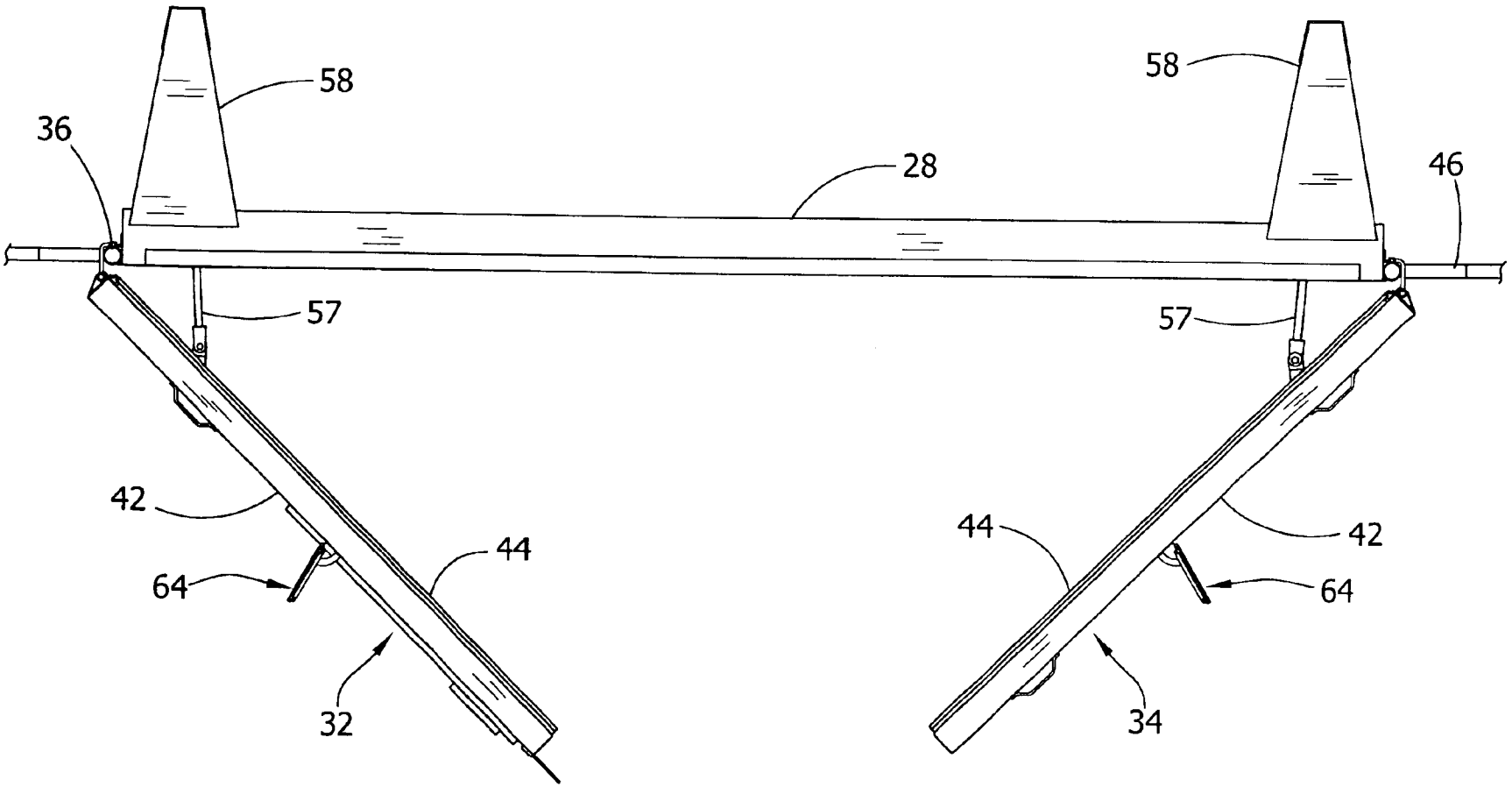
FIG. 5 is a progression of FIG. 4 showing the two door leafs and relief doors in respective open positions.

In a preferred embodiment, the door unit 21 includes a pair of generally rectangular door leafs 32, 34 hinged on the columns 26 of the door frame 22 at opposite sides of the doorway 24 for swinging between an open position (FIG. 5) to permit passage through the doorway and a closed position (FIGS. 1–2) in which the door leafs are generally coplanar to close the doorway. As viewed in FIG. 1, the left-hand leaf is generally designated 32 and the right-hand leaf is generally designated 34. The door leafs are mounted on the columns 26 at opposite sides of the doorway by hinges 36 (FIG. 2), preferably as described in Pat. No. Re. 36,853, incorporated herein by reference. Each leaf may be suitably constructed as described in Pat. No. Re. 36,853 and in patent application Ser. No. 10/003,353 filed Nov. 1, 2001, also incorporated herein by reference, though other types of doors are contemplated. Each leaf has a first front face 42 facing away from the door frame and in a direction in which it swings open, and a second rear face 44 (FIG. 5) facing toward the door frame. The left-hand leaf 32 includes an astragal 45 for sealing the gap between the leafs. In this embodiment, leaf 32 includes a man doorway or opening sized and shaped to allow passage of personnel. A man door is mounted on the leaf 26, as by hinges (not shown), for moving between a closed position for closing the man door opening and an open position for allowing personnel to pass through the man door opening. Note the man door may also be mounted to slide between its open and closed positions, e.g., the man door may be mounted in tracks (not shown).

As illustrated in FIG. 1, the stopping system includes a wall 46 extending at least partway across the passageway P. In this embodiment, the wall includes a top panel structure TP of the type described in Pat. No. Re. 36,853, incorporated herein by reference, to close the space between the lintel 28 of the frame 22 and the ceiling C of the mine passageway. The gaps between the columns 26 of the door frame 22 and the ribs L, R of the passageway may be closed by vertical panels VP of the wall 46, also described in the aforementioned patent. It is contemplated that the wall be made of masonry or other materials.

Figure 2:
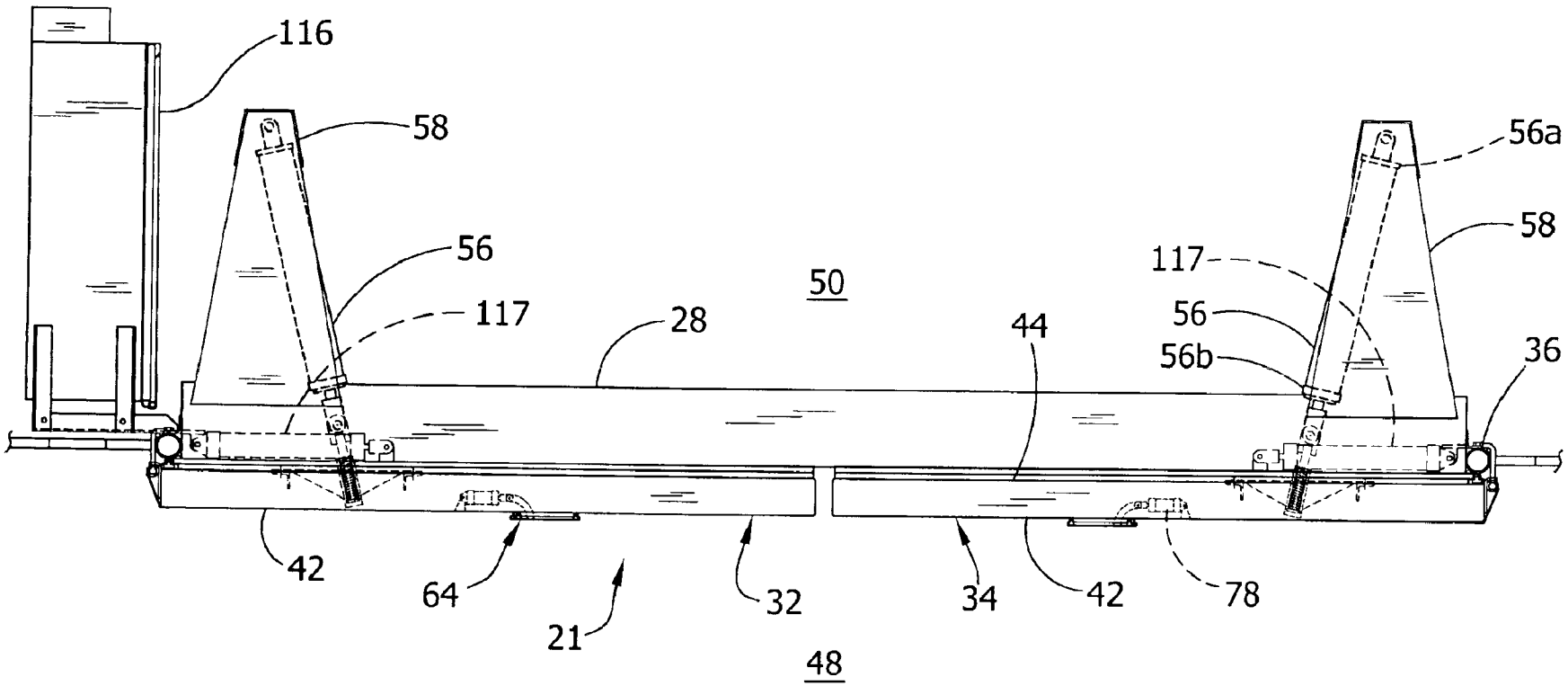
FIG. 2 is a plan view of the stopping and door unit of FIG. 1.

The stopping system 20 is used to substantially seal against air flow through the passageway P, thereby creating an air pressure differential across the stopping system with a normally high pressure side 48 and a normally low pressure side 50 (FIG. 2). This pressure differential applies force to the stopping system 20 in a direction from the high pressure side 48 toward the low pressure side 50. As properly mounted in the passageway, the front face 42 of each leaf faces the high pressure side 48, and the rear face 44 faces the low pressure side 50. It is to be understood that the high pressure side and the low pressure side may switch under some circumstances but are normally in one orientation. Moreover, it is contemplated within the scope of this invention that the doors be intentionally or unintentionally mounted "backwards," i.e., such that the front face faces the low pressure side, and the rear face faces the high pressure side.

A power mechanism is associated with each leaf 32, 34 to effect its movement between open and closed positions. This mechanism includes power actuators in the form of extensible double-acting piston cylinders 56 each of which is pivotally mounted to a support 58 extending from the lintel. The cylinders 56 are similar to those described in detail in U.S. Pat. No. 6,425,820 (which is incorporated herein by reference), except that the cylinders of this embodiment are pneumatically powered (hereinafter, pneumatic) rather than hydraulically powered. Each cylinder 56 has a closed end 56*a*, a rod end 56*b* and a piston rod 57 that is extendable and retractable with pressurized fluid. A suitable piston cylinder is Model No. JK19226 available from Jack Kennedy Metal Products & Buildings, Inc., Taylorville, Ill. 62568.

Figure 4:
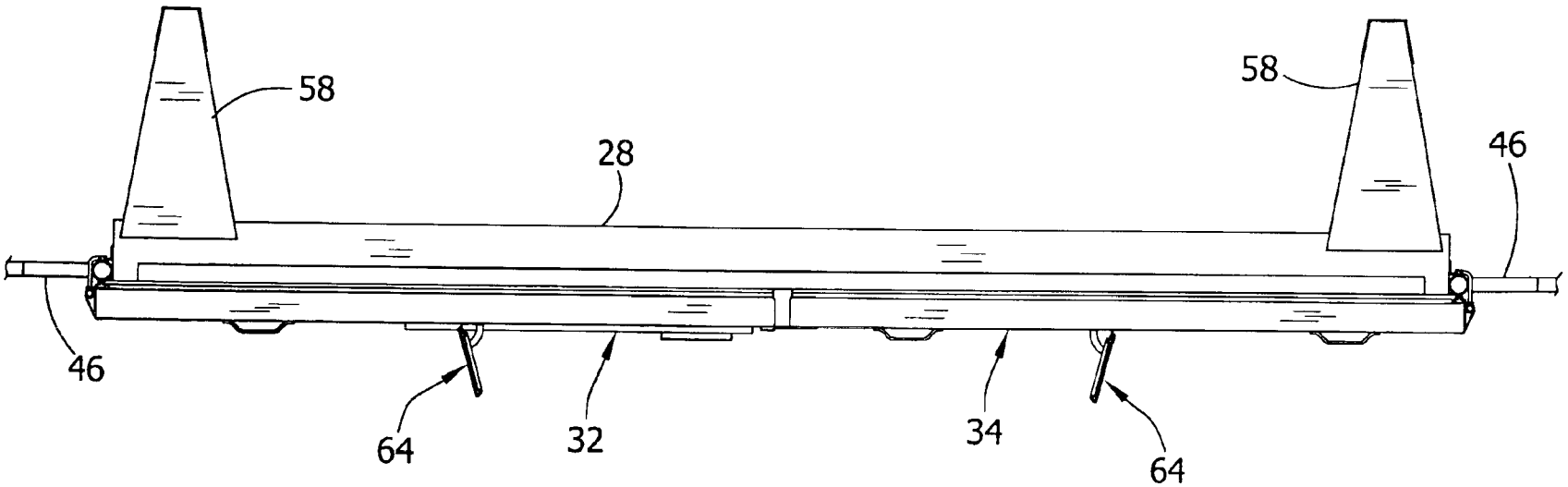
FIG. 4 is a plan view like FIG. 2 showing the relief doors in an open position.
Figure 4A:
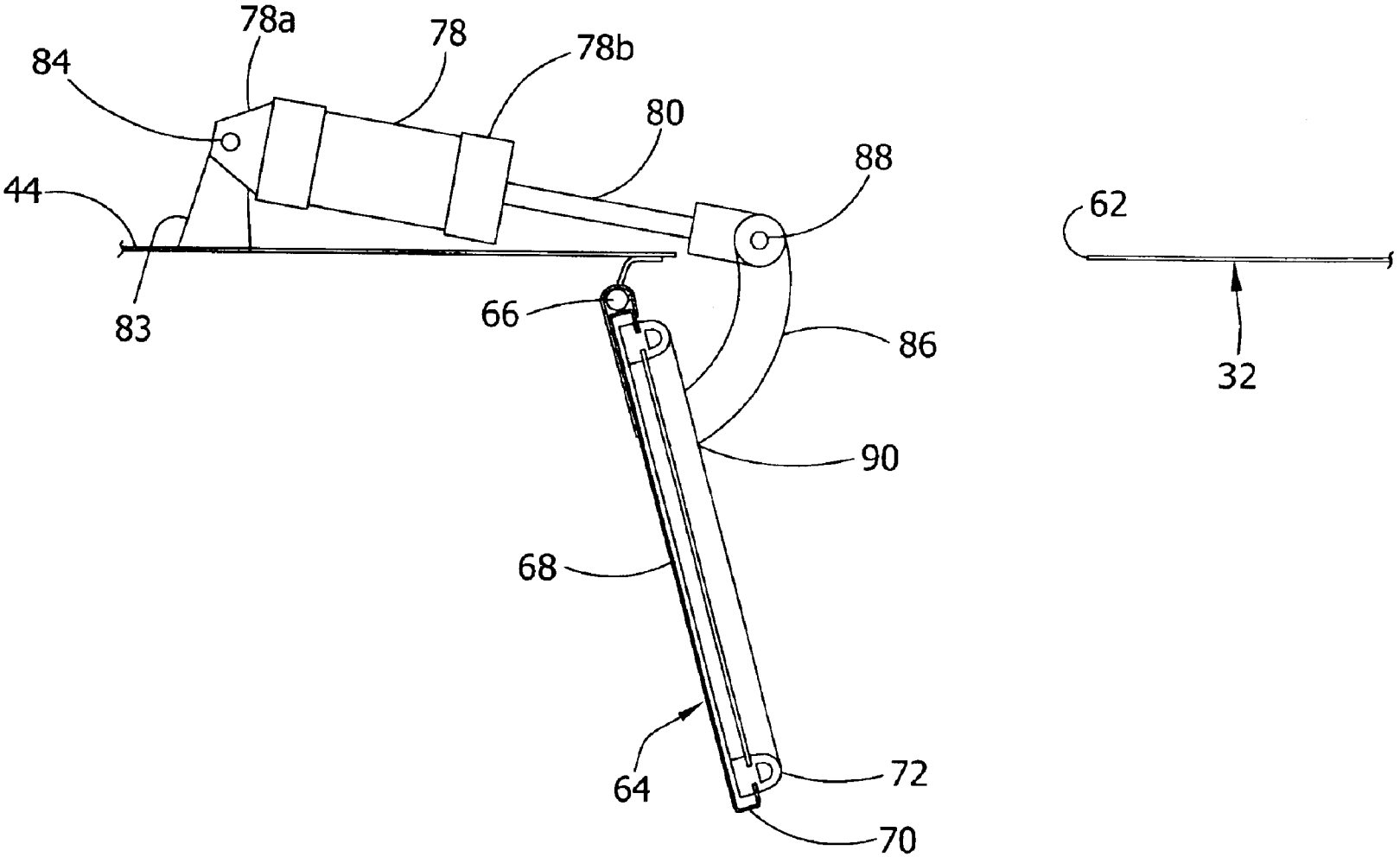
FIG. 4A is an enlarged view of one of the opened relief doors of FIG. 4.

Referring to FIGS. 1 and 2, at least one leaf 32, 34 includes a relief opening 62 therein for passage of air through the leaf from adjacent the high pressure side 48 (e.g., adjacent the front face 42) of the leaf to adjacent the low pressure side 50 (e.g., adjacent the rear face 44) to more nearly equalize the pressure on the faces and thereby reduce the force required to open or close each leaf. In this embodiment, there is a relief opening 62 in each leaf 32, 34, though it is contemplated to include just one relief door in the door unit. The relief opening 62 is generally rectangular, e.g., square as shown, though other shapes are contemplated. A closure or relief door, generally designated 64, is mounted, as by hinges 66, on each leaf 32, 34 and is movable between a closed position blocking passage of air through the relief opening and an open position allowing passage of air therethrough. Each relief door 64 is sized and shaped to close the relief opening 62 and comprises, in one embodiment, a single panel 68 of sheet metal (e.g., square as shown) although other constructions are contemplated. Edges 70 of the door may be reinforced, as by being bent to form a channel as shown. A seal 72 (e.g., a D-shaped rubber seal as shown in FIG. 4A) is attached to the edges 70 and extends around the periphery of the relief door 64 for engaging the respective leaf 32, 34 to form a substantially air-tight seal therebetween when the relief door is in the closed position. Preferably, the relief opening 62 is spaced from the man door 40, i.e., is not in the man door, so that the relief door power mechanism (as further described below) does not obstruct the man door opening 38 when the man door is in its open position.

Figure 3:
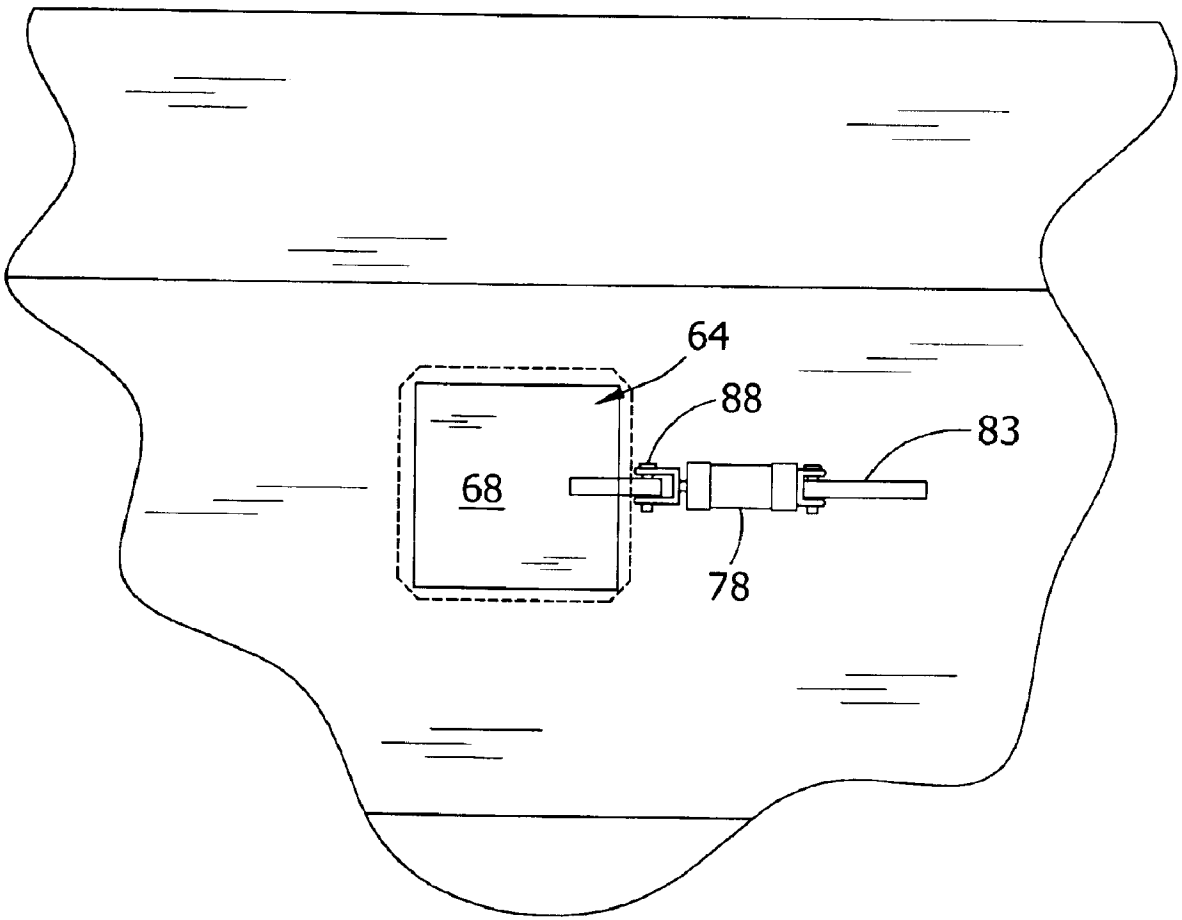
FIG. 3 is an enlarged rear elevation of a door leaf showing a relief opening and relief door.

Referring to FIGS. 3 and 4A, each relief door 64 is operated by a power mechanism comprising, in one embodiment, power actuators, such as pneumatic, extensible double-acting piston cylinders (hereinafter relief cylinders 78). A suitable piston cylinder is Model No. JK25220 available from Jack Kennedy Metal Products & Buildings, Inc., Taylorville, Ill. 62568. It is contemplated that hydraulic cylinders, as well as single-acting cylinders be used within the scope of this invention. Briefly, in a preferred embodiment each relief cylinder 78 includes a closed end 78*a*, a rod end 78*b*, and a piston rod 80 that is extendable and retractable with pressurized fluid (e.g., air in a pneumatic system or liquid hydraulic fluid in a hydraulic system). Each relief cylinder 78 is pivotally connected to a support 83 on the rear face of each leaf, as by a clevis-type connection 84. A rigid link 86 has a first end 88 pivotally connected to the piston rod and a second end 90 fixed, as by welding, to the relief door 64. The link 86 is curved to transfer the linear motion of the piston rod 80 through the angle between the cylinder 78 and the relief door 64. (As shown, the angle is about 90°, though the angle will vary.) Because the link is curved, the relief cylinder 78 may be mounted close to and generally parallel to the leaf 32, 34 so that the relief cylinder does not protrude substantially from the leaf and obstruct the doorway. As will be understood, the connection between the piston rod 80 and relief door 64 may be made in other ways within the scope of this invention. In addition, the piston rod 80 may connect directly to the relief door 64 (i.e., no connecting link therebetween) where, for example, the relief door is mounted for linear motion. Other types of actuators, e.g., linear actuators or screw cylinders may be used within the scope of this invention. Further, the relief door 64 of this embodiment is power-operated, but it may, in some circumstances, be manually-operated within the scope of this invention.

Figure 6:
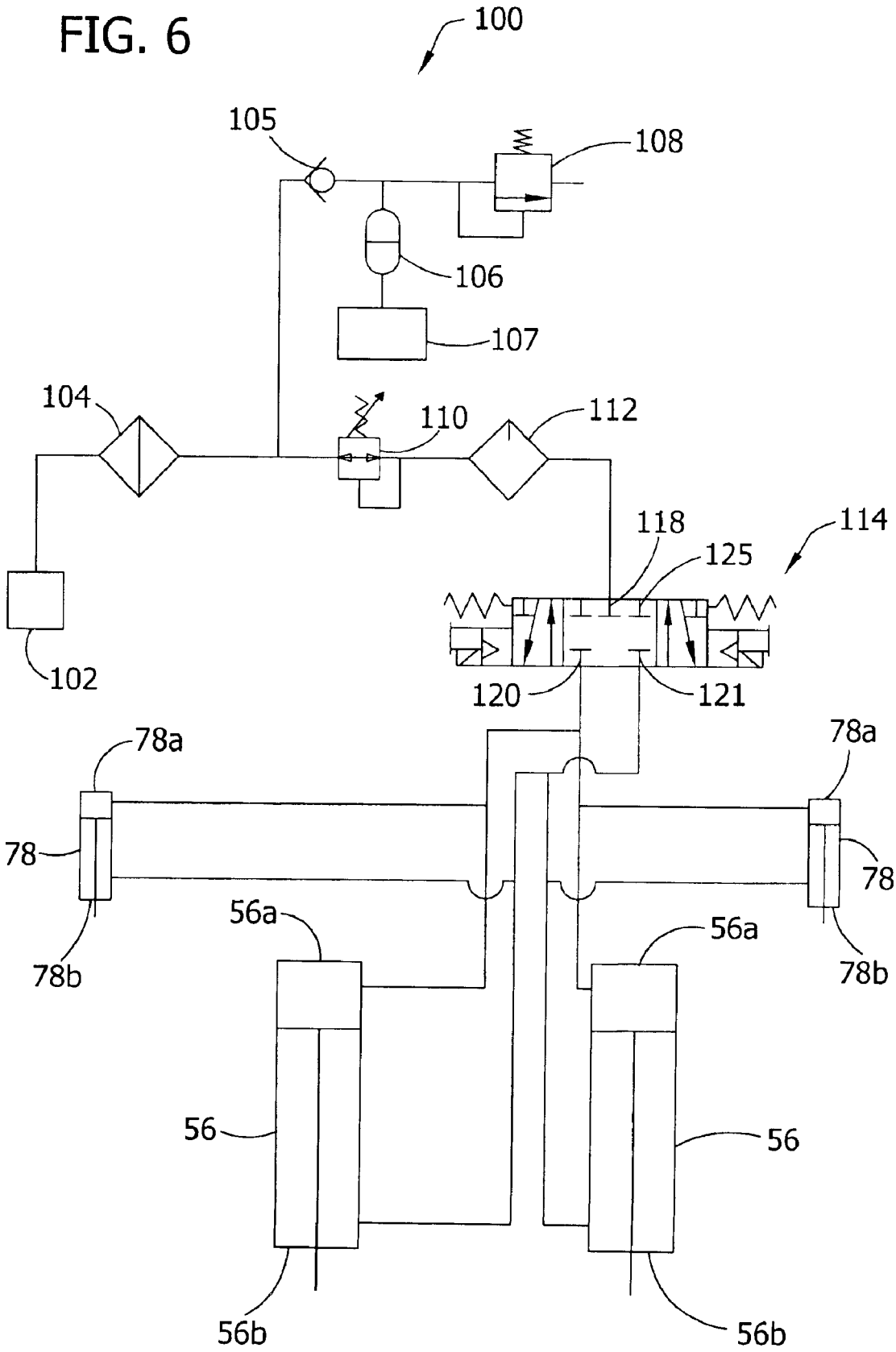
FIG. 6 is a schematic diagram of a pneumatic circuit of the door unit.

Referring to FIG. 6, the power mechanism includes an electrically controlled pneumatic circuit, generally designated 100, for powering and controlling the cylinders. Generally, the circuit includes, in one embodiment, a compressed air source 102 (generally, pressurized fluid), a filter 104, a check valve 105, a pressurized oil reservoir 106 connected to a checking system 107, a pressure relief valve 108, an air pressure regulator 110, an air line oiler 112 and a valve generally designated 114. In one embodiment, a housing 116 (shown in FIG. 2 and omitted from FIGS. 4, 5) is disposed adjacent the door unit 21 and contains all the above-listed components of the circuit 100 except for the air source 102 and portions of the checking system. The circuit 100 may include only a single air source 102, and more preferably, the air source is the mine's pre-existing compressed air source (typically standard equipment of the mine) so that no new source of fluid power needs to be installed to power the system of this invention. The air source may provide air at a variety of pressures, typically about 60 to about 120 psi, but can vary to as low as about 40 psi and as high as about 350 psi. The source 102 is typically located remotely from the door unit 21 and air lines (e.g., conventional tubing for carrying pressurized air) extends from the source to the remainder of the circuit 100 at the door. Note that use of a hydraulic circuit, the system described in co-pending patent application Ser. No. 10/037,514, filed Jan. 4, 2002 which is incorporated herein by reference, or more than one source of air or other power source is contemplated within the scope of the invention.

The filter 104 is in fluid communication with the air source 102 and is adapted for filtering the air to inhibit passage of particles and condensate that may interfere with downstream components in the circuit, such as the regulator 110, the valve 114 and the cylinders 56, 78. Air flows through the filter and then a portion of the air preferably flows to the checking system 107 which is preferably of one or more of the types described in our co-pending U.S. Patent Application entitled "Pneumatically-Powered Mine Door Installation With Hydraulic Checking System," filed simultaneously and incorporated herein by reference. The system 107 includes, for example, hydraulic cylinders 117 (FIG. 2, omitted for clarity from FIGS. 4, 5, and 8) for controlling leaf speed, e.g., to prevent runaway of the door in case of an obstruction blocking the door, and for controlling the sequence in which the leafs 32, 34 close. A check valve 140 is preferably included upstream of the checking system to prevent back flow of air and back flow of oil from the reservoir 106. The pressure relief valve 108 is disposed downstream from the oil reservoir 106 and is operable to relieve air pressure if pressure in the circuit 100 exceeds normal operating pressure. The remainder of the air flows through the air pressure regulator 110, which is adapted to maintain a substantially constant rate of air flow therethrough so that air pressure at the valve is substantially constant. The air line oiler 112 is preferably disposed between the regulator and the valve for lubricating the valve 114 and the cylinders 56, 78.

The valve 114 of this embodiment is a 4-way, 3-position solenoid activated spring return spool valve. The valve 114 includes a single air supply inlet port 118, first and second outlet ports 120, 121, and two vent ports 125. The first outlet port 120 of the valve 114 is connected via parallel lines to the closed ends 56*a*, 78*a* of the cylinders 56, 78, and the second outlet port 121 of the valve is connected via parallel lines with rod ends 56*b*, 78*b* of the cylinders. The vent ports 125 vent air to the atmosphere. A spool of the valve 114 is movable from a center position in which flow through the valve is blocked, to first and second positions for moving the cylinder rods. In the first position, air is directed from the inlet port 118 through the first outlet port 120 to the closed ends 56*a*, 78*a* of the cylinders to extend the piston rods 57, 80 of the respective cylinders 56, 78, and simultaneously, rod ends 56*b*, 78*b* of the cylinders are vented through one of the vent ports 125 to prevent air pressure from building up therein. Conversely, in the second position, air is directed from the inlet port 118 through the second outlet port 121 to the rod ends 56*b*, 78*b* of the cylinders 56, 78 to retract the piston rods 57, 80, and the closed ends 56*a*, 78*a* of the cylinders are vented through the other vent port 125. In this embodiment, all four cylinders 56, 78 are plumbed in parallel, but non-parallel configurations are within the scope of the invention. The valve 114 is preferably also manually operable, and a suitable spool valve is Model No. JK19460 available from Jack Kennedy Metal Products & Buildings, Inc., Taylorville, Ill. 62568.

In operation, the valve 114 is activated by a signal from an electrical switch (not shown; suitable switches 184A–D are described in U.S. Pat. No. 6,425,820, incorporated herein by reference) which causes the spool to move to the first position and thereby extend the piston rods 57, 80. Due to the parallel lines, there is substantially equal air pressure against the pistons of the cylinders 56, 78. However, the piston rods 80 of the relief door cylinders 78 will extend prior to the piston rods 57 of the leaf cylinders 56 when there is significant air pressure against the doors. This phenomena is due to the fact that the ratio of the piston area of the relief door cylinder to the relief door area is much less than the ratio of the piston area of the leaf cylinder to the leaf area, as is further described in the example below. The checking system controls closing of the leafs to ensure that the right-hand leaf 34 closes before the left-hand leaf 32 so that the astragal 45 on the left-hand leaf covers the gap between the leafs. Thus, the power mechanism described above is constructed to apply driving force to the relief doors 64 and to the leafs 32, 34 for opening and closing the relief doors and the leafs. Moreover, the parallel lines to the relief door and leaf cylinders cause the relief door and the leaf to open in sequence.

Figure 7:
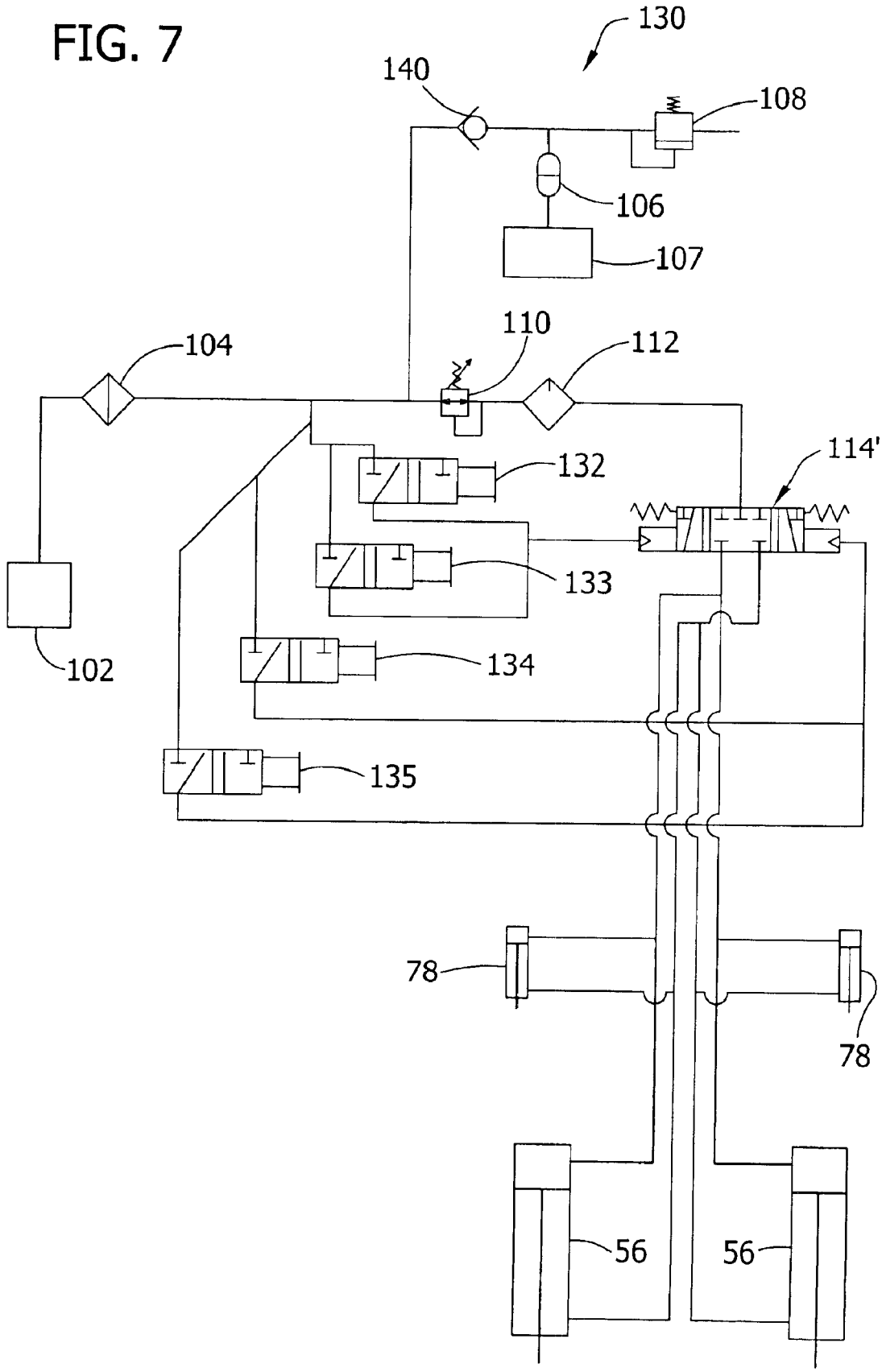
FIG. 7 is a schematic diagram of an alternative pneumatic circuit of the door unit.

Referring to FIG. 7, the power mechanism may alternatively include a pneumatically controlled pneumatic circuit, generally designated 130, for the cylinders. The circuit of this embodiment includes a pneumatically activated spool valve 114' (in place of the solenoid activated valve 114) and four pneumatically controlled operation valves 132–135 for operating the spool. This circuit may be mounted in "return air" of the mine because it does not require electrical power and thus there is no risk of a spark from the circuit. The circuit 130 includes a check valve 140 upstream of the checking system to prevent back flow of air.

The invention allows much less force or power to be used to open the door leafs. As an example, if each leaf face defines an area of 36 square feet and each leaf cylinder has a piston diameter of about 6 inches, the ratio of the leaf area to the piston area is 183:1 Further, if each relief door face defines an area of 1 foot square, and each relief door cylinder has a piston diameter of about 2 inches, then the ratio of the relief door area to the piston area is 46:1. Thus, in this simplified example in which all other variables are assumed to be equal, each relief door will be able to open against almost 4 times more air pressure than the leafs. When the relief door 64 opens, air pressure against the leafs 32, 34 is greatly reduced, e.g., by about at least about one-third, more preferably by at least about one-half, and the leaf cylinders should then be able to open the leafs. Accordingly, the leaf cylinders can be sized smaller than would otherwise be necessary to open the leafs. As will be understood by those of skill in the art, in designing the relief door and power mechanism for the relief door, the relief cylinder 78 is sized to open the relief door in the presence of a maximum expected pressure differential, e.g. about twenty (20) IWG. Also, the area of the relief opening 62 must be large enough to relieve sufficient air pressure against the leaf 32, 34 and thereby allow the leaf cylinders 56 to open the leafs.

Figure 8:
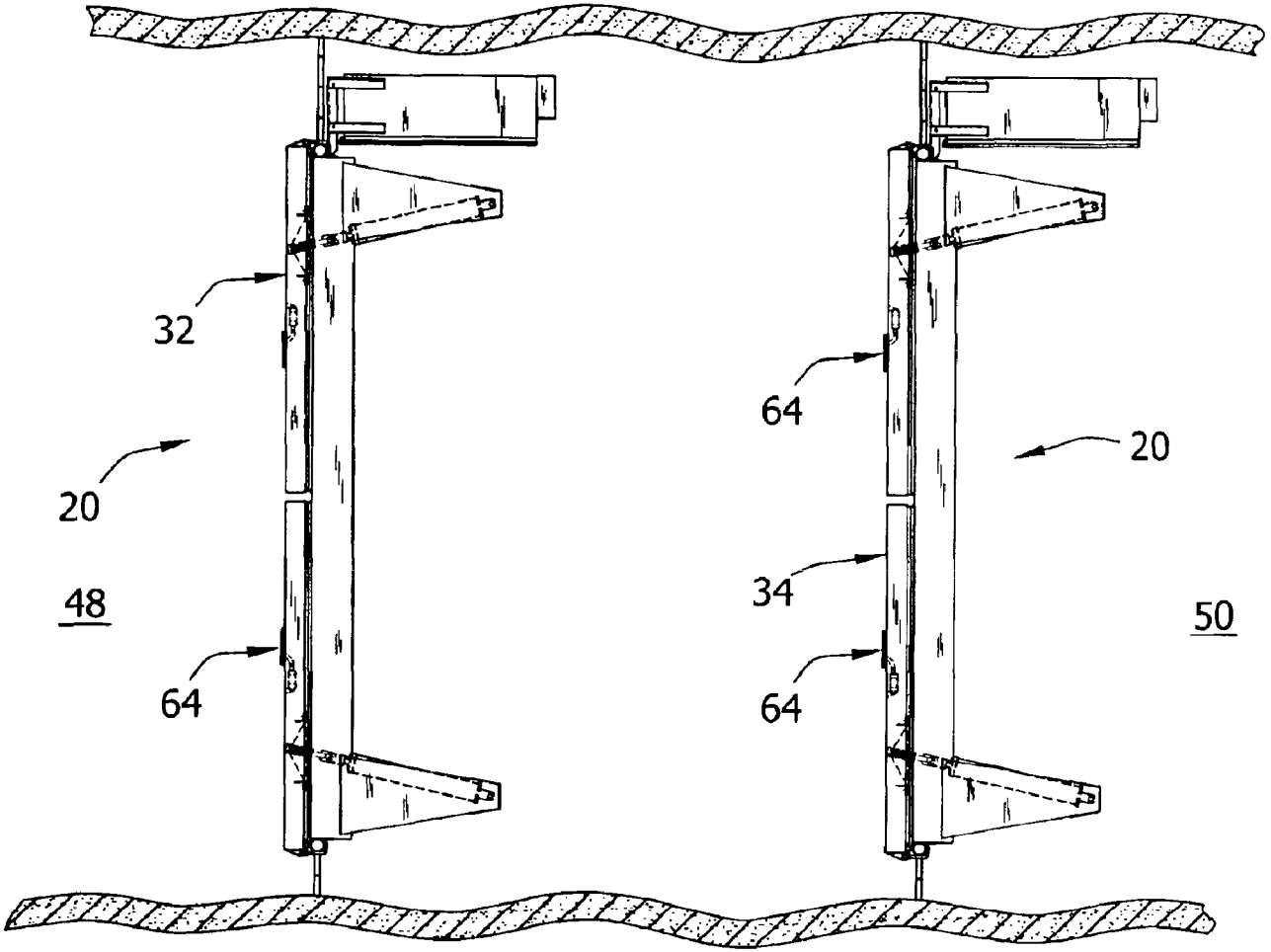
FIG. 8 is a plan view of an airlock formed by two of said stoppings.

FIG. 8 illustrates a mine stopping system of the present invention which includes two stoppings 20 of the type described above. The stoppings are positioned in the passageway P in spaced apart relation to form an airlock with an airlock space therebetween. As viewed in FIG. 8, the high pressure side 48 should be to the left of the left-hand stopping 20. In this particular embodiment, both stoppings 20 include relief openings 62 and relief doors 64 as described above, but it is contemplated that one of the stoppings 20 not include a relief opening. The door units 21 may be controlled by a system similar to that described in U.S. Pat. No. 6,425,820 (which is incorporated herein by reference) including an interlock for preventing both doors being opened simultaneously.

Figure 9:
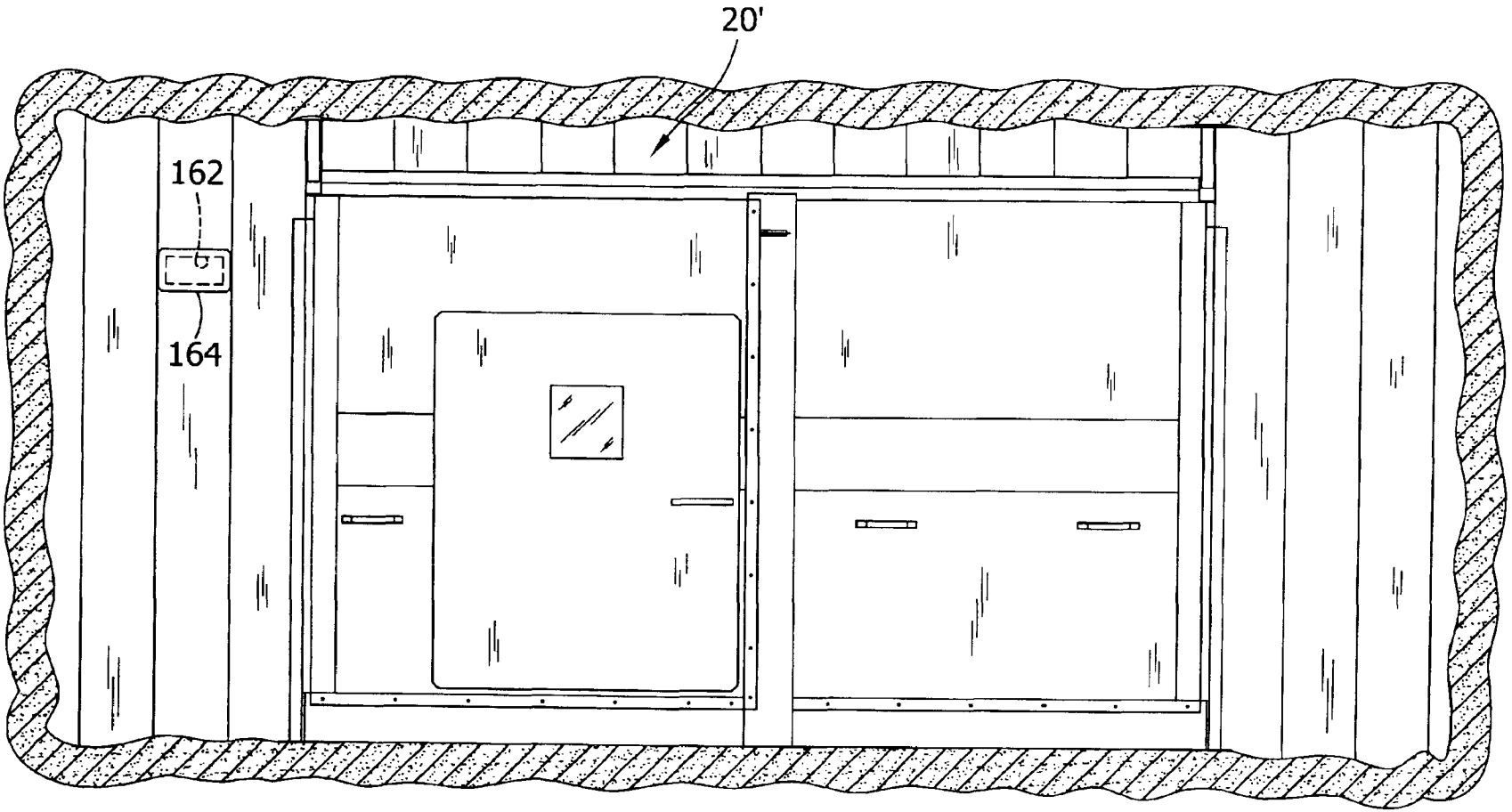
FIG. 9 is a front elevation of a mine stopping and door unit of a second embodiment of the invention.

As illustrated in the embodiment of FIGS. 1–5, the relief openings 62 and relief doors 64 are preferably disposed in positions that are convenient for running power lines (e.g., pneumatic lines) and that do not obstruct personnel and machinery passing through the doorway. The relief opening and relief door are preferably not located on the man door 40 because such location is likely to obstruct personnel passing therethrough. However, the relief opening(s) and door(s) may be disposed anywhere on the stopping, door unit (including in the man door) and frame (or on any combination thereof) within the scope of this invention. To illustrate the point, the stopping 20' of an alternative embodiment shown in FIG. 9, includes a relief opening 162 in one of the stopping panels (generally, the stopping wall) and a power-operated relief door 164 substantially identical to the relief openings and doors described above.

The relief door 64 may be constructed in many other ways within the scope of this invention. For example, the relief door may include multiple panels, may be any shape and instead of being mounted on hinges, the relief door may be mounted to slide between its open and closed positions, e.g., mounted in tracks (not shown). Further, the relief door need not necessarily be power-operated.

Figure 10:
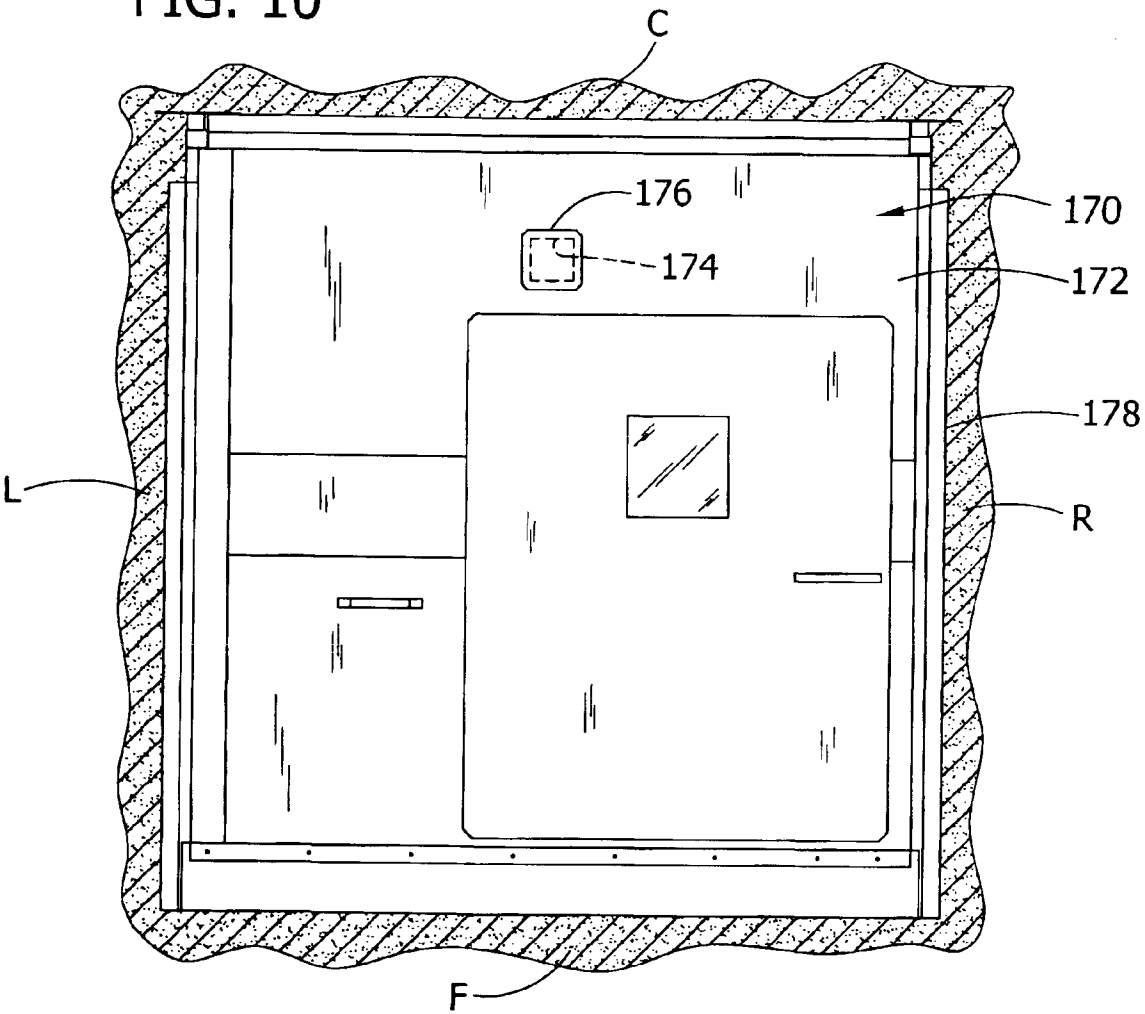
FIG. 10 is a front elevation of a single-leaf door unit installed in a mine passageway.

FIG. 10 shows another embodiment wherein a door unit generally designated 170 comprises a single leaf 172 and a relief opening 174 therein. A relief door 176, constructed similar to the relief doors described above, covers the relief opening 174. Door frame 178 mounts the single leaf 172 and, in this embodiment, directly engages the ribs R, L, ceiling C and floor F of the passageway P such that no stopping panels are required to seal the passageway. As discussed above, the relief opening 174 is preferably disposed in the single leaf 172 but may also be disposed on the man door.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A mine door for installation in a passageway of a mine comprising:

a leaf adapted to be mounted in the passageway for swinging between a closed position and an open position, the leaf having a first face facing in a direction in which it swings open and a second face facing an opposite direction in which it swings closed, said leaf being adapted for installation in the passageway where the leaf when closed is subject to a differential in air pressure involving higher pressure on one of said faces of the leaf than on the other of said faces of the leaf, said leaf having an opening therein for passage of air therethrough from adjacent said one of said faces of the leaf to adjacent the other of said faces to more nearly equalize the pressure on said faces and thereby reduce the force required to open or close the leaf, a closure mounted adjacent said opening and movable between a closed position blocking passage of air through said opening and an open position allowing passage of air, and a first actuator mounted adjacent said closure for moving said closure between the open position and the closed position.

2. A mine door as set forth in claim 1 installed in the mine such that the higher pressure is on the first face of the leaf so that the leaf opens toward the higher pressure.

3. A mine door as set forth in claim 2 wherein the closure is hinged on the leaf so that the closure opens toward the higher pressure.

4. A mine door as set forth in claim 1 wherein the closure is hinged on the leaf so that the closure opens toward the higher pressure.

5. A mine door as set forth in claim 1 wherein the first actuator for moving the closure is operated by a power mechanism adapted for opening the leaf after opening the closure.

6. A mine door as set forth in claim 5 wherein the power mechanism includes a single source of pressurized fluid, the first actuator operably connected to the closure and to the single source, and a second actuator operably connected to the leaf and to the single source, the power mechanism being constructed to apply driving force to the closure and to the leaf for opening and closing the closure and the leaf.

7. A mine door as set forth in claim 6 wherein the power mechanism further includes parallel fluid supply lines to the first and second actuators adapted for opening the closure and the leaf in sequence.

8. A mine door as set forth in claim 7 wherein the pressurized fluid is air.

9. A mine door as set forth in claim 1 in combination with a door frame adapted for installation in the passageway and adapted for mounting the leaf.

10. A mine door as set forth in claim 9 wherein the door frame is adapted for mounting a second leaf adjacent the first-mentioned leaf, respective faces of the first and second leafs being substantially coplanar when the leafs are in the closed position.

11. A mine door as set forth in claim 1 wherein the leaf includes a man door opening and a man door mounted on the leaf for moving between a closed position for closing the man door opening and an open position for allowing personnel to pass through the man door opening, the closure being spaced from the man door.

12. A mine stopping system installed in a passageway of a mine for closing the passageway, the system comprising:

a wall extending at least partway across the passageway, a door frame installed in or adjacent the wall to define a doorway to allow passage of machinery, a door leaf hinged on the door frame for swinging between a closed position in the doorway and an open position, the leaf having a first face facing in a direction in which it swings open and a second face facing an opposite direction, the leaf when closed being subject to a differential in air pressure involving higher pressure on one of said faces of the leaf than on the other of said faces, said door leaf being substantially parallel with the door frame when the leaf is in the closed position, an opening disposed in at least one of said leaf, wall and door frame for passage of air therethrough to more nearly equalize the pressure on said faces of the leaf and thereby reduce the force required to open or close the leaf, and a power-operated closure for said at least one opening movable between a closed position blocking passage of air and an open position allowing passage of air.

13. A mine stopping system as set forth in claim 12 wherein the opening is disposed in said leaf.

14. A mine stopping system as set forth in claim 12 wherein the opening is disposed in said wall.

15. A mine stopping system as set forth in claim 12 wherein the leaf is power-operated, the stopping system further comprising a power mechanism including a single source of pressurized fluid for operating said closure and said leaf, said power mechanism adapted for opening the leaf only after the closure is opened.

16. A mine stopping system as set forth in claim 15 wherein the power mechanism further includes a first actuator operably connected to the closure and to the single source, and a second actuator operably connected to the leaf and to the single source, the power mechanism constructed to apply driving force to the closure and to the leaf for opening and closing the closure and the leaf.

17. A mine stopping system as set forth in claim 16 wherein the leaf is installed such that the higher pressure is on the first face of the leaf so that the leaf opens toward the higher pressure, and wherein the closure is mounted so that the closure opens toward the higher pressure.

18. A mine stopping system as set forth in claim 17 wherein the power mechanism further includes parallel fluid supply lines to the first and second actuators and a valve movable to an open position for allowing fluid to flow to the first and second actuators in parallel and to cause the closure and the leaf to open in sequence.

19. A mine door unit for installation in a passageway of a mine comprising:

a door frame adapted to be installed in the passageway to define a doorway sized and shaped to allow passage of machinery, a leaf hinged on the door frame for moving between a closed position for at least partially closing the doorway and an open position to permit passage of machinery through the doorway, a man doorway in the leaf sized and shaped to allow passage of personnel, a man door mounted on the leaf for closing the man doorway, a pressure relief opening in the leaf and not in the man door, and a closure mounted on the leaf for moving between a closed position for closing the pressure relief opening and an open position for relieving pressure against the leaf to facilitate opening of the leaf, the closure not being on the man door.

20. A mine door unit as set forth in claim 19 wherein the closure is power-operated.

21. A mine stopping system forming an airlock space in a mine passageway comprising:

a plurality of stoppings mounted in the passageway in spaced apart relation, said stoppings forming an airlock with an airlock space therebetween, each stopping including a door leaf mounted for moving between open and closed positions, at least one of said stoppings including a pressure relief opening therein and a closure mounted adjacent the opening for moving between a closed position for closing the pressure relief opening and an open position for relieving air pressure against the leaf to facilitate opening or closing of the leaf, and a first actuator mounted adjacent said closure for moving said closure between the open position and the closed position.

22. A mine stopping system as set forth in claim 21 wherein the opening is in the leaf of said at least one stopping and the closure is mounted on the leaf.

23. A mine stopping system as set forth in claim 22 wherein the first actuator for moving the closure is operated by a power mechanism adapted for opening the leaf after opening the closure.

24. A mine stopping system as set forth in claim 23 wherein the power mechanism includes a single source of pressurized fluid, the first actuator operably connected to the closure and to the single source, and a second actuator operably connected to the leaf and to the single source, the power mechanism constructed to apply driving force to the closure and to the leaf for opening and closing the closure and the leaf.

25. A mine door for installation in a passageway of a mine comprising:

a power-operated leaf adapted to be mounted in the passageway for swinging between a closed position and an open position, the leaf having a first face facing in a direction in which it swings open and a second face facing an opposite direction in which it swings closed, said leaf being adapted for installation in the passageway where the leaf when closed is subject to a differential in air pressure involving higher pressure on said first face of the leaf than on the second face of the leaf, an opening formed in the leaf for passage of air therethrough from adjacent said one of said faces of the leaf to adjacent the other of said faces to more nearly equalize the pressure on said faces and thereby reduce the force required to open or close the leaf, and a power-operated closure mounted adjacent said opening and movable between a closed position blocking passage of air through said opening and an open position allowing passage of air, said closure being mounted such that said closure opens toward the higher pressure, said power-operated closure being movable from said closed position to said open position against pressures up to a first maximum pressure differential, said power-operated leaf being moveable from said closed position to said open position against pressures up to a second maximum pressure differential, said second maximum pressure differential being less than said first maximum pressure differential.

26. A mine door for installation in a passageway of a mine as set forth in claim 25 wherein said first maximum pressure is between about 2 and about 4 times greater than the second maximum pressure.

27. A mine door for installation in a passageway of a mine as set forth in claim 25 wherein said first maximum pressure is about 20 inches water gauge.

28. A mine door for installation in a passageway of a mine as set forth in claim 26 wherein said second maximum pressure is between about 5 inches water gauge and about 10 inches water gauge.

29. A mine door for installation in a passageway of a mine as set forth in claim 25 wherein the power-operated closure and the power-operated leaf are operated by a power mechanism adapted for opening the leaf after opening the closure.

30. A mine door as set forth in claim 29 wherein the power mechanism includes a single source of pressurized fluid, a first actuator operably connected to the closure and to the single source, and a second actuator operably connected to the leaf and to the single source, the power mechanism being constructed to apply driving force to the closure and to the leaf for opening and closing the closure and the leaf.

31. A mine door for installation in a passageway of a mine comprising:

a leaf adapted to be mounted in the passageway for swinging between a closed position and an open position, the leaf having a first face facing in a direction in which it swings open and a second face facing an opposite direction in which it swings closed, said leaf being adapted for installation in the passageway where the leaf when closed is subject to a differential in air pressure involving higher pressure on said first face of the leaf than on said second face of the leaf, a first actuator for moving said leaf between said closed position and said open position, an opening formed in the leaf for passage of air therethrough from adjacent said one of said faces of the leaf to adjacent the other of said faces to more nearly equalize the pressure on said faces and thereby reduce the force required to open or close the leaf, a closure movable between a closed position blocking passage of air through said opening and an open position allowing passage of air, and a second actuator for moving said closure between the open position and the closed position, the second actuator being mounted to said second face of the leaf such that when the leaf is in the closed position the second actuator is not subjected to the higher pressure.

32. A mine door for installation in a passageway of a mine as set forth in claim 31 wherein said first actuator is located in said passageway such that when the leaf is in the closed position the first actuator is opposed to said second face of the leaf and is not subjected to the higher pressure.

33. A mine door for installation in a passageway of a mine comprising:

a power-operated leaf adapted to be mounted in the passageway for swinging between a closed position and an open position, the leaf having a first face facing in a direction in which it swings open and a second face facing an opposite direction in which it swings closed, said leaf being adapted for installation in the passageway where the leaf when closed is subject to a differential in air pressure involving higher pressure on said first face of the leaf than on said second face of the leaf, an opening formed in the leaf for passage of air therethrough from adjacent said one of said faces of the leaf to adjacent the other of said faces to more nearly equalize the pressure on said faces and thereby reduce the force required to open or close the leaf, a power-operated closure movable between a closed position blocking passage of air through said opening and an open position allowing passage of air, and a switch for simultaneously activating said power-operated leaf and said power-operated closure.

34. A mine door for installation in a passageway of a mine as set forth in claim 33 wherein the power-operated closure will open prior to power-operated leaf when the air pressure against the first face of the leaf exceeds a predetermined pressure.

35. A mine door for installation in a passageway of a mine as set forth in claim 34 wherein said predetermined pressure is between about 5 inches water gauge and about 10 inches water gauge.

* * * * *